US009814306B2

(12) United States Patent
Köder et al.

(10) Patent No.: US 9,814,306 B2
(45) Date of Patent: Nov. 14, 2017

(54) TELESCOPIC COLUMN THAT CAN BE CALIBRATED, PIECE OF FURNITURE HAVING A TELESCOPIC COLUMN THAT CAN BE CALIBRATED, AND METHOD FOR CALIBRATING A TELESCOPIC COLUMN

(75) Inventors: Michael Köder, Plochingen (DE); Oliver Spahn, Mühltal (DE)

(73) Assignee: Kessebohmer Produktions GMBH & CO. KG (DE)

( * ) Notice: Subject to any disclaimer, the term of this patent is extended or adjusted under 35 U.S.C. 154(b) by 0 days.

(21) Appl. No.: 14/111,899

(22) PCT Filed: Apr. 11, 2012

(86) PCT No.: PCT/EP2012/056581

§ 371 (c)(1),
(2), (4) Date: Dec. 30, 2013

(87) PCT Pub. No.: WO2012/140085

PCT Pub. Date: Oct. 18, 2012

(65) Prior Publication Data

US 2014/0103174 A1 Apr. 17, 2014

(30) Foreign Application Priority Data

Apr. 15, 2011 (DE) ..... 10 2011 007 540

(51) Int. Cl.
*A47B 9/04* (2006.01)
*A47B 9/20* (2006.01)
(Continued)

(52) U.S. Cl.
CPC ..... *A47B 9/20* (2013.01); *A47B 9/00* (2013.01); *A47B 9/04* (2013.01); *A47B 9/12* (2013.01);
(Continued)

(58) Field of Classification Search
CPC .... A47B 9/00; A47B 9/04; A47B 9/12; A47B 2200/0056; A47B 2200/0041;
(Continued)

(56) References Cited

U.S. PATENT DOCUMENTS 4,667,605 A * 5/1987 Bastian ..... A47B 9/20 108/106
5,114,109 A * 5/1992 Fitz et al. ..... B66F 3/24 248/161
(Continued)

FOREIGN PATENT DOCUMENTS

CN 101554268 A 10/2009
CN 101862080 A 10/2010
(Continued)

OTHER PUBLICATIONS

International Search Report & Written Opinion, dated Jun. 6, 2012, for PCT/EP2012/056581.
(Continued)

*Primary Examiner* — Eret McNichols
(74) *Attorney, Agent, or Firm* — Dickinson Wright PLLC

(57) ABSTRACT

The invention relates to a column that can be calibrated, in particular for a piece of furniture, wherein the column 100, 101 that can be calibrated has a stationary part 4, at least one movable part 2, 3, and a calibrating means 6, 13, 14, and the movable part 2, 3 can be transferred from a retracted state to a plurality of extended states, and wherein a calibration position of the column 100, 101 coincides with the position of the movable part 2, 3 in an extended state. Such a column can be used in a piece of furniture as an extendable column.

7 Claims, 7 Drawing Sheets

Figure 1:
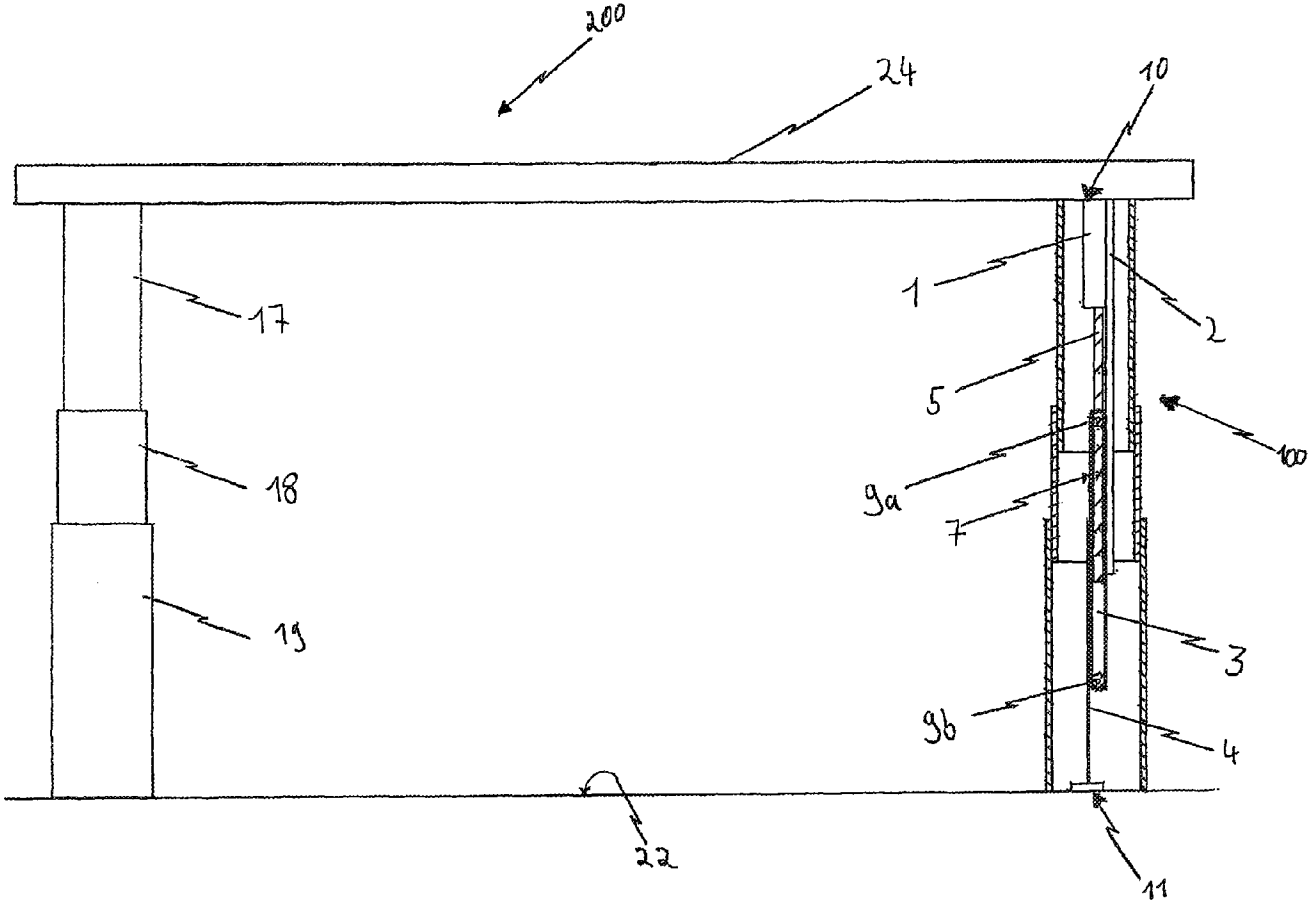

(51) Int. Cl.
*A47B 9/12* (2006.01)
*A47B 9/00* (2006.01)

(52) U.S. Cl.
CPC ..... *A47B 2200/0041* (2013.01); *A47B 2200/0051* (2013.01); *A47B 2200/0052* (2013.01); *A47B 2200/0056* (2013.01); *A47B 2200/0062* (2013.01)

(58) Field of Classification Search
CPC .... A47B 2200/0051; A47B 2200/0052; A47B 2200/0062
USPC ..... 108/144.11; 248/188.5
See application file for complete search history.

(56) References Cited

U.S. PATENT DOCUMENTS

| | | | | |
|---|---|---|---|---|
| 5,224,429 | A * | 7/1993 | Borgman et al. | 108/147 |
| 5,311,827 | A * | 5/1994 | Greene | A47B 9/02 108/147 |
| 6,286,441 | B1 * | 9/2001 | Burdi | A47B 9/00 108/147 |
| 6,289,825 | B1 * | 9/2001 | Long | 108/147 |
| 6,412,427 | B1 * | 7/2002 | Merkt | A47B 9/12 108/147 |
| 6,595,144 | B1 * | 7/2003 | Doyle | 108/147 |
| 7,874,538 | B2 * | 1/2011 | Atlas | A47B 9/04 248/157 |
| 8,342,465 | B2 * | 1/2013 | Koder | A47B 9/04 108/147 |
| 8,783,193 | B2 * | 7/2014 | Scharing | 108/50.01 |
| 9,204,715 | B2 * | 12/2015 | Bonuccelli | |
| 9,380,866 | B1 * | 7/2016 | Davis | A47B 9/20 |
| 2003/0033963 | A1 * | 2/2003 | Doyle | A47B 9/04 108/147.19 |
| 2004/0100169 | A1 * | 5/2004 | Huber et al. | 312/319.5 |
| 2006/0130713 | A1 * | 6/2006 | Jones et al. | 108/106 |
| 2006/0266791 | A1 * | 11/2006 | Koch | A47B 9/00 228/1.1 |
| 2007/0034754 | A1 * | 2/2007 | McKeon | A47B 9/04 248/125.2 |
| 2009/0012634 | A1 * | 1/2009 | Koch | A47C 20/041 700/90 |
| 2009/0078171 | A1 * | 3/2009 | Frost | 108/50.02 |
| 2009/0133609 | A1 * | 5/2009 | Nethken et al. | 108/50.02 |
| 2010/0301186 | A1 * | 12/2010 | Chuang | 248/422 |
| 2011/0215207 | A1 * | 9/2011 | Koder | A47B 9/00 248/157 |
| 2014/0020606 | A1 * | 1/2014 | Benden | A47B 13/00 108/50.14 |
| 2014/0096706 | A1 * | 4/2014 | Labrosse et al. | 108/21 |
| 2014/0137773 | A1 * | 5/2014 | Mandel et al. | 108/50.11 |
| 2015/0007756 | A1 * | 1/2015 | Kollreider et al. | 108/21 |
| 2015/0047538 | A1 * | 2/2015 | Ergun et al. | 108/147 |
| 2016/0227921 | A1 * | 8/2016 | Hansen | A47B 9/12 |

FOREIGN PATENT DOCUMENTS

| | | | | |
|---|---|---|---|---|
| DE | 202005021004 | | 12/2006 | |
| DE | 202005021004 | U1 | 1/2007 | |
| DE | 202005021004111 | | 1/2007 | |
| DE | 202005021004 | U1 * | 2/2007 | |
| DE | 102007057113 | | 5/2009 | |
| DE | 102007057113 | A1 | 5/2009 | |
| DE | 102013107053 | A1 * | 10/2014 | A47B 9/00 |
| EP | 2365408 | A1 | 9/2011 | |
| JP | 04129504 | | 4/1992 | |
| WO | WO 99/20152 | | 4/1999 | |
| WO | WO 99/20152 | A1 | 4/1999 | |
| WO | WO 9920152 | A1 | 4/1999 | |
| WO | WO 2006/043881 | A1 | 4/2006 | |
| WO | WO 2006043881 Al | | 4/2006 | |

OTHER PUBLICATIONS

International Preliminary Report on Patentability & Written Opinion, dated Oct. 24, 2013, for PCT/EP2012/056581.

* cited by examiner

TELESCOPIC COLUMN THAT CAN BE CALIBRATED, PIECE OF FURNITURE HAVING A TELESCOPIC COLUMN THAT CAN BE CALIBRATED, AND METHOD FOR CALIBRATING A TELESCOPIC COLUMN

CROSS REFERENCE TO RELATED APPLICATIONS

The present application is a 35 U.S.C. national stage filing of International Patent Application No. PCT/EP2012/056581, filed 11 Apr. 2012, and through which priority is claimed to German Patent Application No. 10 2011 007 540.2, filed 15 Apr. 2011, the disclosures of which are incorporated herein by reference in their entireties.

The invention relates to a telescopic column that can be calibrated, especially a telescopic column that can be calibrated for furniture, especially tables such as desks and assembly-tables, as well as furniture having a telescopic column that can be calibrated and a method for calibrating the same.

From prior art, there are known furniture with movable parts, such as desks with height-adjustable table-plates or cupboards with movable doors and also further furniture-devices which have to be height-adjustable. Especially tables, such as desks with height-adjustable table-plates are increasing in demand when designing ergonomic work places.

In order to provide a reliable use, columns that are driven by electro-motors need a fixed reference point for synchronizing them by means of a controller. On said reference point, the controller sets its zero-point. The controller counts the pulses said zero-point and gains information about the position of the movable part of the column or the furniture, respectively. This may be achieved by a pulse generator, such as a Hall-sensor.

Due to the constant use, the uneven load, etc., a loss of adjustment of the columns may occur. Said loss of adjustment may especially occur with electrically driven columns, so that, when using a plurality of such columns, e.g. on a table, an uneven height-adjustment may occur.

In order to avoid this, the columns are usually calibrated before the delivery and once again before the final assembly of the furniture. In prior art, the table-plate is transferred into a calibration position ("reset"-position). It is well-known that for such a calibration-method and also for synchronization of a plurality of columns, the columns are moved to the lowest position. Said lowest position is mechanically defined by the minimal height of the adjustable column itself.

If, for example, with different furniture, different designs of table-legs, plate frames or table-plates are used, or structural components are changed in design, dimensions of the furniture may change which also results in the change of the reference point, since it may differ for every piece of furniture. This, however, results in huge efforts when producing and finishing the furniture, since there may be a variety of different modifications.

Further, it is necessary to provide a free space underneath the table, when the column of table has to be calibrated. However, there are often located containers or other pieces of furniture. If such objects are not removed, there may be caused damage on the table or the objects underneath the table during calibration.

It is also conceivable that the zero-point of the table-plate is arranged above the alleged calibration position due to a de-calibration. The controller would not recognize this fact and try to reach the calibration position whereby damaging of the column, the drive mechanism or the furniture may occur after passing the zero-point.

It is therefore an object of the invention to provide a column that can be calibrated for the use in furniture which avoids the disadvantages described above and allows a reliable calibration of the column.

This object is achieved by a device according to claim 1 and claim 9 as well as with the method according to claim 10. Advantageous developments are subject of the dependent claims.

A column according to the invention may be calibrated in an extended state. For this purpose, a movable part is transferred in an extended state with regard to a stationary part of the column and calibration position is reached in an extended state. By providing a calibration position in an extended state of the column, the user-friendliness of the column may be increased. Further, the components of the stationary part can be standardized among the columns and according to applicable norms without being required to adapt the calibration units or the calibration method thereto.

A preferred embodiment of the column that can be calibrated, comprises a stationary part and at least a movable part as well as a calibration means, wherein the movable part can be transferred steplessly from a retracted state in a plurality of extended states. A calibration position coincides with a position of the movable part in an extended state thereof.

In alternative embodiments, the column may also comprise a plurality of movable parts.

In a special embodiment of the invention, the calibration position coincides with a position of the movable part in its completely extended state. In this way, an exact position, namely the position "on block" is given as an absolute measure of the calibration.

In this embodiment, the column may provide a blocking means on the movable part and/or the stationary part, wherein the blocking means blocks a movement of the movable part beyond this position. Said position may also be a predetermined position which is arranged in front of the mechanical end position of the movable part. In this way, a damage of the movable or the stationary part as well as the drive mechanism may be prevented.

Further, the blocking means may have a soft layer provided between the blocking means and the end of the movable portion of, for instance, a spindle running in the stationary portion. This soft layer may attenuate a contact between the end position of the movable part and the blocking means in order to more effectively prevent damage. It is also conceivable to provide a blocking means that is made of a soft material.

In an alternative embodiment, the calibration position may additionally or alternatively coincide with a position of the movable part when said movable part is only partly extended. In this way, the calibration of the zero-point may be achieved when passing the calibration position. It is also possible that a steering of the calibration position may be achieved by a controller when a reset of the column is desired.

This may be achieved by providing a detection means in the calibrating means which detects the attainment of the calibration position. Said detection means may be designed as a mechanical, electronic, e.g. inductive or capacitive, or optical switch. In one embodiment, it is conceivable that a passing of the calibration position causes an activation of the switch so that the column is constantly in an "activated state" when it is transferred from a retracted position in an extended position by passing the calibration position; conversely, when the movable part of the column is transferred from an extended state in the direction of a retracted state by passing the calibration position, the column is in a "non-activated state". An adjustment of the calibration position may be achieved by controlling and regulating the column in a kind of "pendulum movement" between an activated and a non-activated state. This may allow an exact setting and calibration of the column without having a mechanical load on the drive mechanism or on the components interconnected with each other, respectively.

Likewise, the calibration may be achieved by simply passing the calibration point. If, however, a calibration point is provided in a position in which the column is only partly extended, it is not required to use cables for the furniture that are long enough to allow the column to be extendable to a maximum position.

Further, the calibrating means may also have a plurality of detection means disposed over the direction of movement of the movable part and which are serially operated during a movement of the movable part. In this way, a calibration may be achieved during a movement, e.g. in a case where the drive power or the lifting speed are known. In this way, it is also possible to verify the function of the drive mechanism when the distances between the individual detection means are exactly known. This may further increase the functionality and reliability of the adjustable column.

The column which can be calibrated may for instance be used in furniture, e.g. in a table, especially in a (office-)desk, which shall be height-adjustable. It is also conceivable to use the columns in assembly-tables or assembly-cupboards.

It is obvious that also furniture other than a table come into question, e.g. chairs, benches, cupboards, etc., comprising adjustable components. An extension and retraction thereby refers exemplarily on a classic telescopic column. However, there are other columns conceivable which are retractable and extendable, but also foldable in and out. The column described above and the method for calibrating said column are to be understood analogous on alternative columns and are covered by the present invention.

Details, further advantages and developments of the invention will be described in more detail with the embodiments, referring to the illustrations.

Figure 2A:
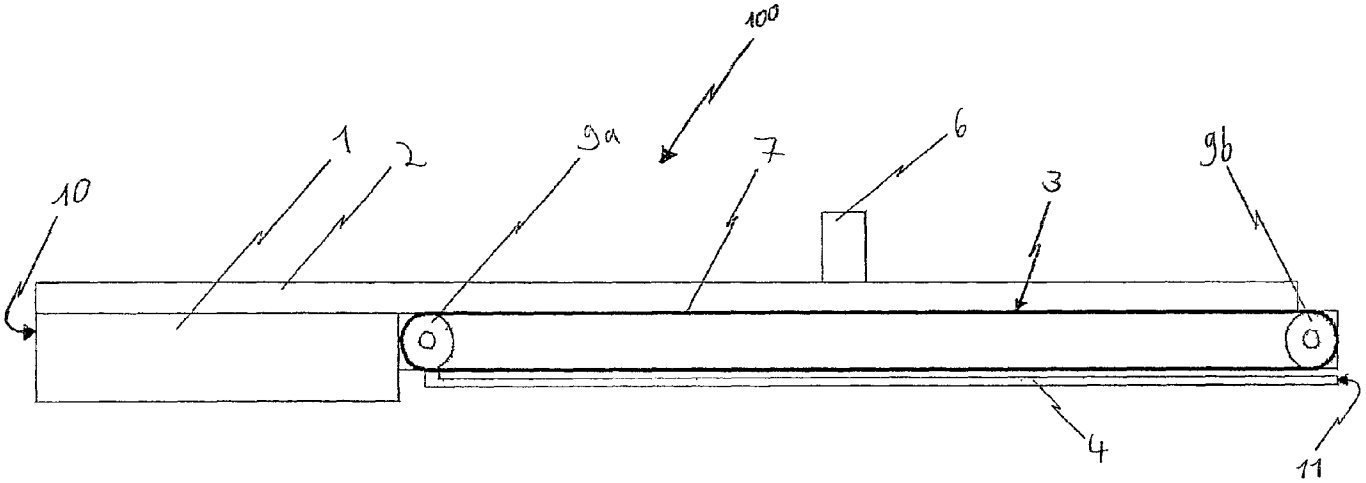
Figures 3A, 3B:
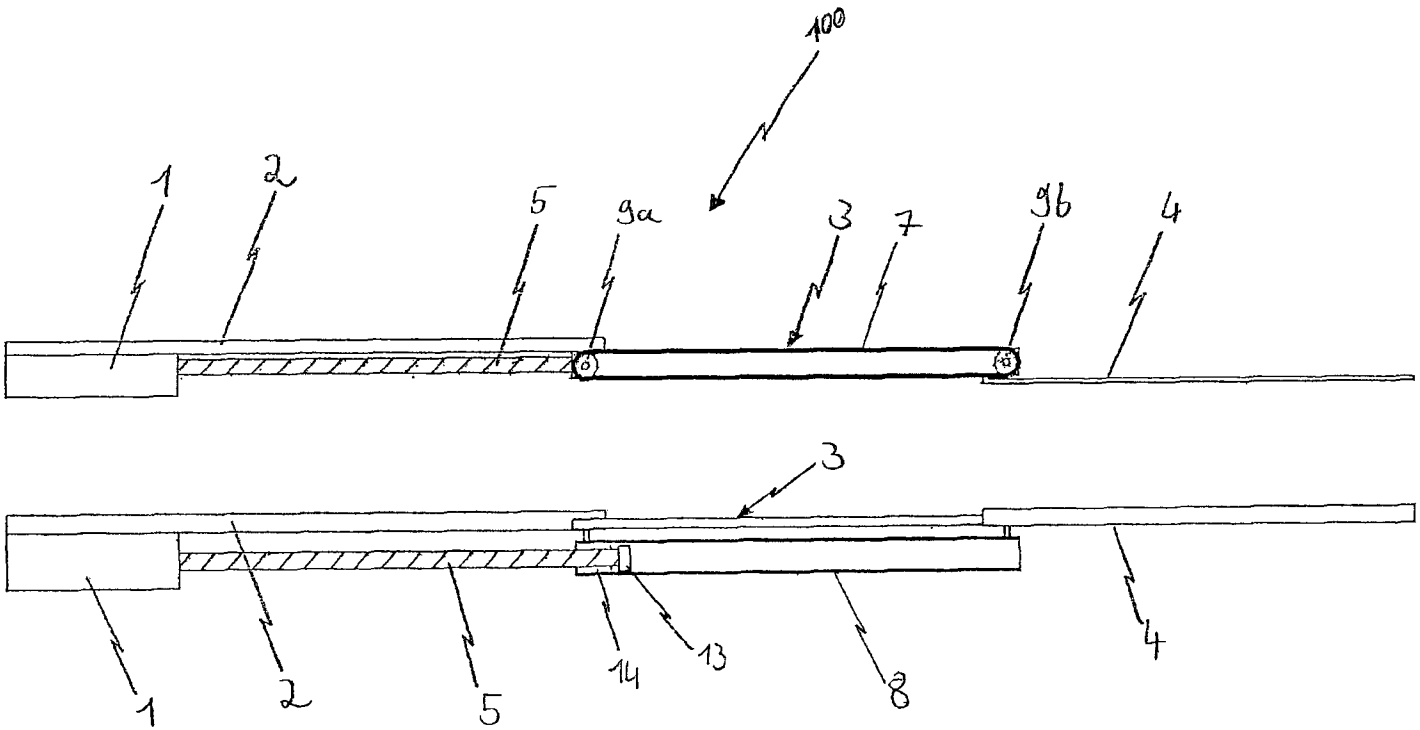
Figure 4:
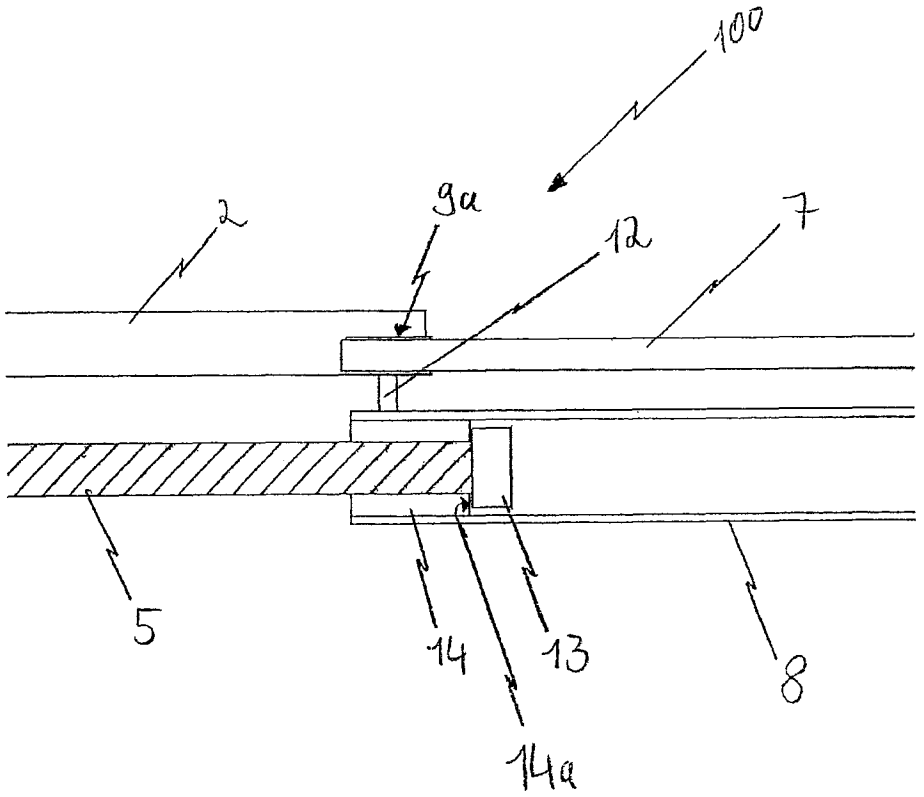
Figure 6A:
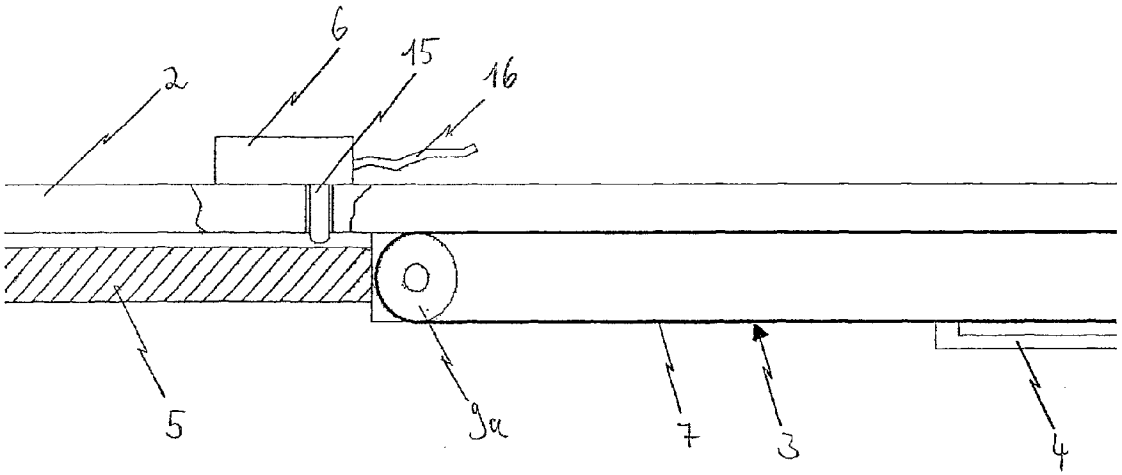
Figure 6B:
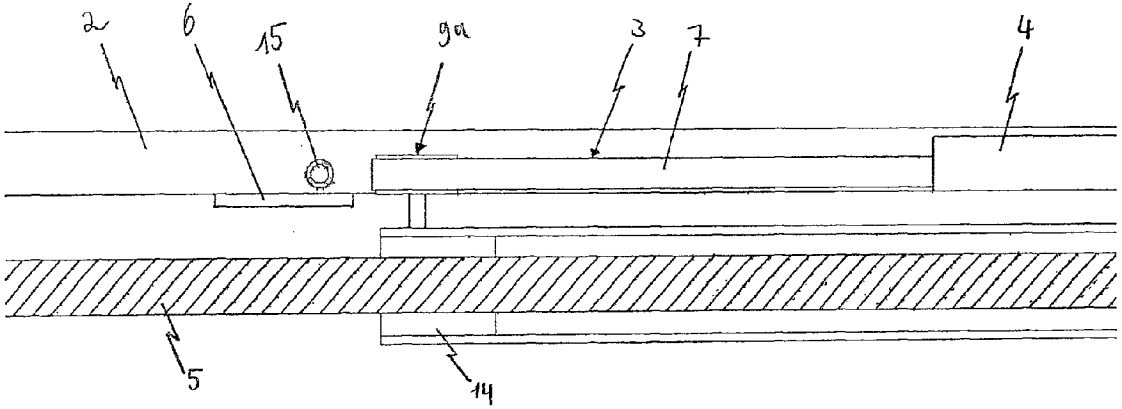
Figure 7:
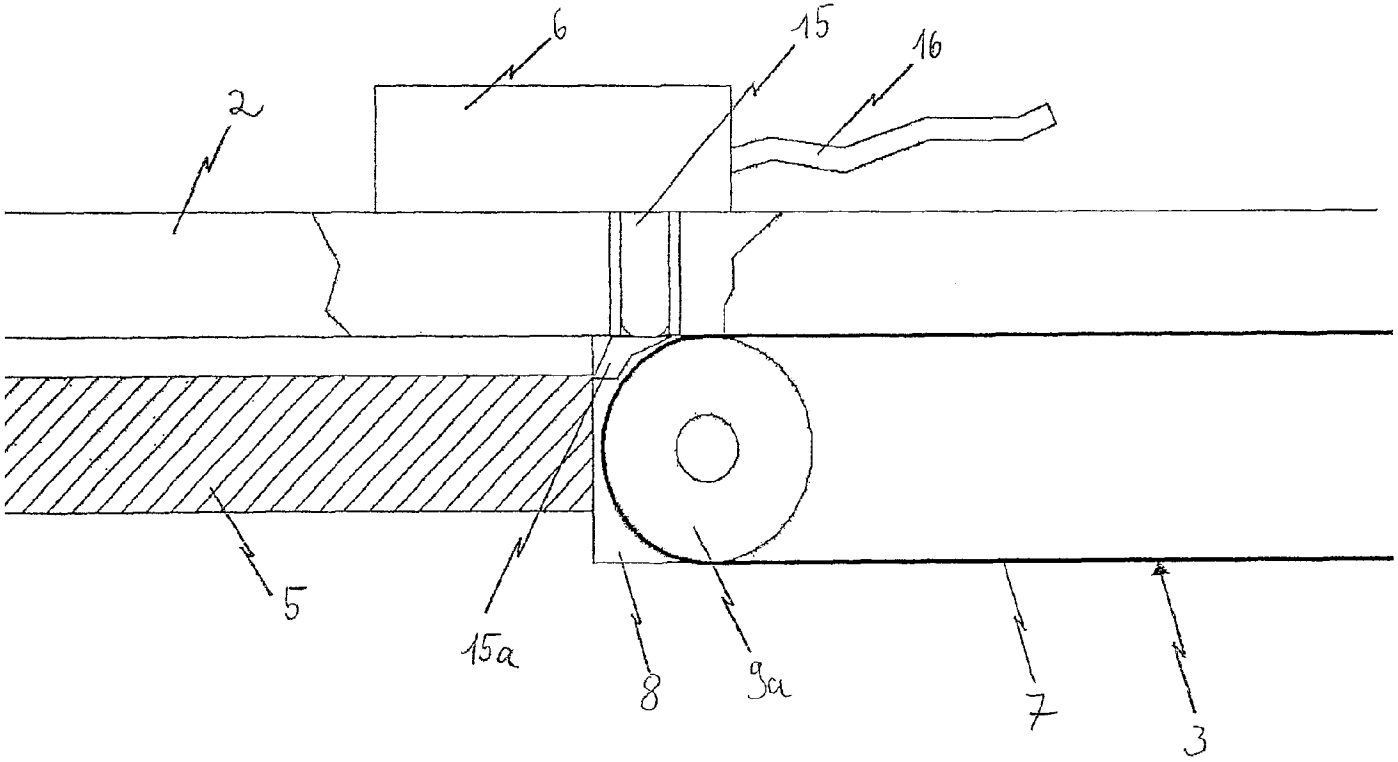

Therein shows:

FIG. 1 a height-adjustable table with a column that can be calibrated according to one embodiment of the invention, FIG. 2 a column according to the invention in an embodiment of the invention in a retracted stage a) in a side view, b) in a front view, FIG. 3 a column according to the invention in an embodiment in an extended state, a) in a side view, b) in a front view, FIG. 4 an enlarged view of a calibration position of the column according to an embodiment, FIG. 5 a column that can be calibrated according to one embodiment of the invention, a) in a side view, b) in a front view, FIG. 6 an enlarged view of a calibration position of the column according to FIG. 5, a) in a side view, b) in a front view, FIG. 7 a detailed view of the column according to FIG. 6 in a side view.

FIG. 1 shows a table 200 with a height-adjustable column 100. The table 200 in the shown embodiment comprises two columns 100. On a side facing the bottom 22, the column is connected with a table stand by means of a lower support 11. The column is a telescopic column and consists of a lower telescopic part 19, a middle telescopic part 18 and an upper telescopic part 17. The telescopic parts 17, 18, 19 have decreasing diameters, beginning with the lower telescopic part 19 and the middle telescopic part 18 up to the upper telescopic part 17, so that the lower telescopic part 19 can receive the middle telescopic part 18 and the middle telescopic part 18 can receive the upper telescopic part 19. The columns 100 are height-adjustable, which will be described in detail later.

While the columns 100 in the shown embodiment have a substantially cylindrical design, it is also possible that the columns or the individual telescopic parts have another profile such as a triangle, a square or the like. The telescopic parts 17, 18, 19 are preferably formed telescopically, as described above.

On the columns 100, a table-plate 24 is arranged. The columns are connected to the table-plate 24 by means of a support 10.

In the shown embodiment, the column 100 has a motor 1 comprising a transmission unit. The motor 1 is mounted on a side of the column 100 facing the table-plate 24. The motor 1 extends from the side of the column 100 facing the table-plate 24 in a direction of a direction of extension of the column 100, thus in the direction of the bottom 22. Further an upper thrust rod 2 is mounted on the motor 1 in the same direction of extension. The upper thrust rod 2 may also be mounted on the table-plate 24.

In other embodiments, the motor may also have a direct drive and be provided without any transmission.

The motor 1 or its transmission unit further has a spindle 5 which is driven by the motor 1. The spindle extends in parallel with the upper thrust rod 2 from the side of the column 100 facing the table plate 24 in the direction of the bottom 22. The motor 1, the upper thrust rod 2 and the spindle 5 are, at least partially, arranged in the upper telescopic part 17 of the column 100.

It has to be noted that the motor 1 may also be provided in the middle telescopic part 18 or the lower telescopic part 19.

On the upper thrust rod 2 or the spindle 5, a middle part 3 with bearing rollers 9*a*, 9*b* is attached. The middle part 3 is arranged in a way that it is engaged with the upper thrust rod 2 and can be displaced along the spindle 5, and in parallel with the upper thrust rod 2. The middle part is substantially arranged in the area of the middle telescopic part 18.

The roller 9*a* is arranged on an end side of the middle part 3 facing the motor and the roller 9*b* is arranged on an end side of the middle part 3 averting the motor. The middle part 3 is connected to the upper thrust rod 2 by means of an axis 12 for bearing the roller 9*a* (cf. FIG. 4). The roller 9*b* is connected to a lower thrust rod 4. The lower thrust rod 4 also extends in parallel with the extension direction of the upper thrust rod 2 or the middle part 3 down to the lower support 11 on the table-stand. The lower thrust rod 4 is substantially arranged in the area of the lower telescopic part.

Analogous to the roller 9*a*, the roller 9*b* is connected to the lower thrust rod and movable along the lower thrust rod 4. In a retracted state, the roller 9*a* is arranged on an end side of the upper thrust rod 2 facing the motor 1. In this position, the roller 9*b* is arranged on an end side of the lower thrust rod 4 averting the motor 1.

Figure 2B:
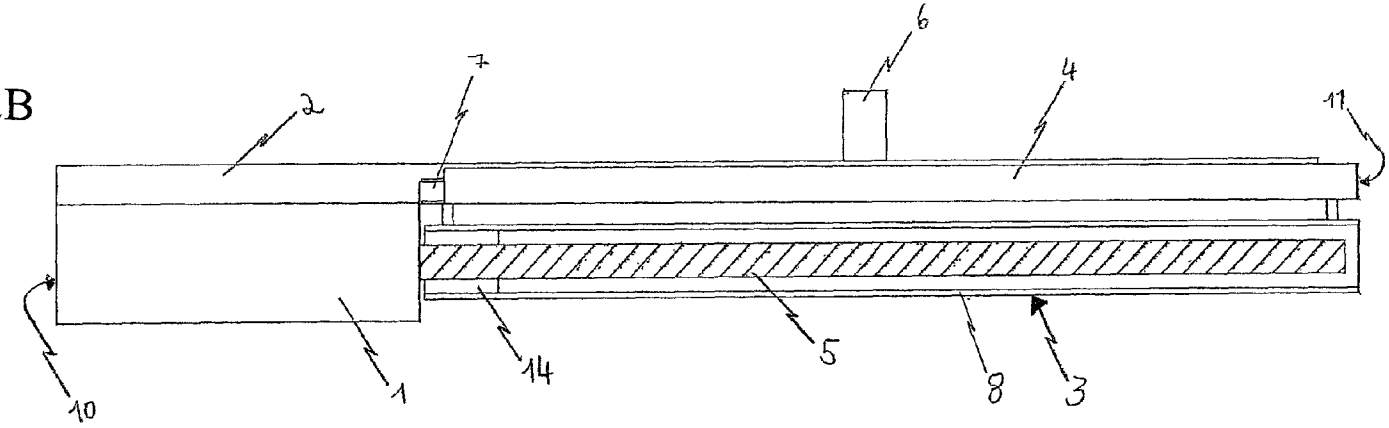

As it can be seen from FIG. 2, a steel belt 7 is arranged about the rollers 9*a*, 9*b*. Further, it can be seen that the middle part 3 is formed in a way that it can receive the spindle 5. Therefore, the middle part has a middle thrust rod 8 which is substantially designed cylindrical or tubular. The middle thrust rod 8 has a hollow interior space, wherein its diameter is large enough to receive the spindle 5 of the motor 1 (cf. FIG. 2*b*).

As it can be further seen in FIGS. 2*a* and 2*b*, in the embodiment shown here, a sensor unit 6, also referred to as calibration means, is provided on the upper thrust rod 2. The sensor unit 6 is arranged on a side of the upper thrust rod 2 averting the motor 1. Further, the sensor unit 6 is arranged in an area of the upper thrust rod 2 in which the upper thrust rod 2 and the middle part 3 are arranged in parallel with each other in a retracted state of the column 100. In this position, the middle part 3 of the column 100 is located in a direction which runs transversely to its direction of extension and placed at the height of the sensor unit 6 within the range of action of the sensor unit 6.

In the frontal cross-sectional view according to FIG. 2*b*, it can be seen how the spindle 5 is received by the middle part 3 or the middle thrust rod 8, respectively, in a retracted state of the column 100. In this retracted state, the lower thrust rod 4 is arranged in parallel with the upper thrust rod 2 and the middle part 3 of the column 100. Here, the rollers 9*a* and 9*b* are arranged in a way that the steel belt 7 arranged about the rollers 9*a*, 9*b* runs in parallel with the direction of extension of the upper thrust rod 2, the middle part 3 and the lower thrust rod 4. The roller 9*a* is thereby connected to the middle thrust rod 8 of the middle part 3 of the column 100 by means of an axis 12, which runs transversely to the direction of extension of the thrust rod 2. Analogously, the roller 9*b* is connected to the lower thrust rod 4.

A limit stop surface 14 is arranged on an end portion of the middle thrust rod 8 facing the motor 1. The limit stop surface 14 may have a soft material or at least a soft layer or a soft intermediate layer 14*a* on a side of the limit stop surface 14 averting the motor, as shown in FIG. 4.

FIG. 3*a*, 3*b* shows an extended state of the column 100. In the extended state of the column 100, the roller 9*a* of the middle part 3 is arranged on an end of the upper thrust rod 2 averting the motor. Further, the spindle 5 is not received by the middle part 3 or the middle thrust rod 8, respectively, in an extended state. Due to the extension, the roller 9*b* is arranged on an end of the lower thrust rod 4 facing the motor.

As it can be seen in FIG. 3*b*, which is a frontal cross-sectional view, an area of the spindle 5 averting the motor is provided with an upper limit stop 13. According to FIG. 3, in an extended state, the upper limit stop 13 of the spindle 5 comes into an effective contact with the limit stop surface 14 or the soft intermediate layer 14*a* of the middle thrust rod 8. The upper limit stop 13 may be, for instance, connected to the spindle 5 by means of a screw or an alternative fixing means. In FIG. 3, due to the effective contact between the upper limit stop 13 and the limit stop surface 14, a further movement or extension of the column, respectively, is avoided. This is a fixed position and is, in this context, referred to as calibration position. Therefore, the limit stop surface 14 and the upper limit stop 13 together can also be referred to as calibrating means for calibrating the column 100. The soft intermediate layer 14*a* may be arranged both, on a side of the limit stop surface 14 averting the motor and on a side of the upper limit stop 13 facing the motor.

FIG. 4 shows an enlarged view of a section of FIG. 3*b*. Therein, the upper limit stop 13 is in an effective contact with the limit stop surface 14 or the intermediate layer 14*a*, respectively. Therefore, a further extension of the column is not possible.

The spindle 5 preferably has an ascending screw thread on its surface, which interacts with the middle part 3 or the middle thrust rod 8, respectively, and thereby causes an adjustment of the column. It is also conceivable that the limit stop surface 14 is formed with a thread that fits the thread of the spindle 5 which would effect a reliable adjustment of the spindle towards the middle part 3.

There are alternative embodiments for adjusting the column conceivable, e.g. hydraulic or pneumatic adjustments that can be used analogous to a spindle.

Figures 5A, 5B:
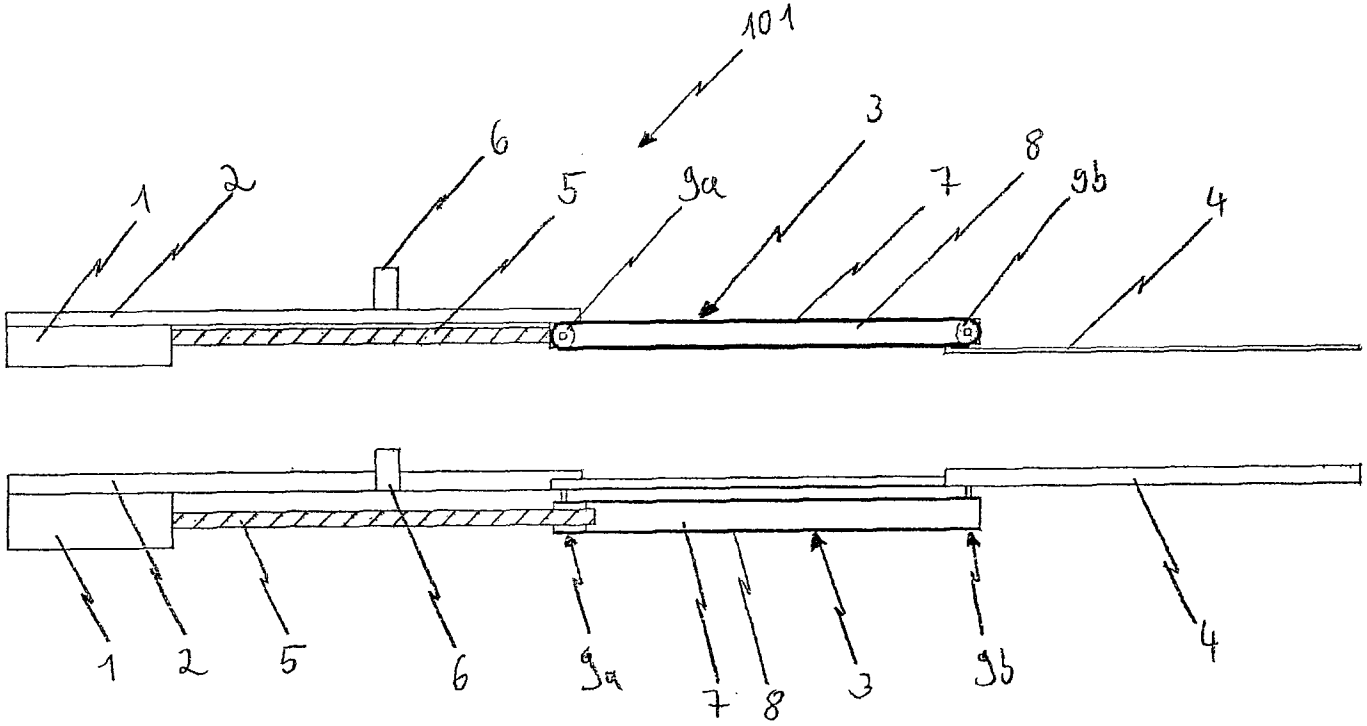

FIG. 5*a* shows a side view of a column 101 as a further embodiment of the invention. The column 101 has a sensor unit 6 as a calibrating means instead of a limit stop surface 14 with an upper limit stop 13. In this embodiment of the column 101, a calibration is achieved at a position of the sensor unit 6 which is shown in detail in FIG. 6*a*, 6*b* and FIG. 7. As already mentioned, in a retracted state, the sensor unit 6 is arranged in a way that the middle part 3 is located in an area which runs transversely to the extension direction of the upper thrust rod 2 at the height of the sensor unit in the range of action of the sensor unit 6. In the extended position according to FIG. 5, in this area running transversely to the upper thrust rod 2 starting from the sensor unit 6, the middle part 3 is not in the range of action of the sensor unit 6.

In FIG. 6, a middle position of the column 101 is shown in an enlarged view of the area of the sensor unit 6. As it can be seen in the side view according to FIG. 6*a*, here, the part of the middle part 3 facing the motor 1 is in direct proximity to the sensor unit 6. In this embodiment, the sensor unit 6 has an operating pin 15 as a detection means. In the shown embodiment, said operating pin is a mechanical switch.

In alternative embodiments, the operating pin 15 may also be a contact receiver, a light barrier or another optical detection means, an electronic detection means that is, for instance, composed of a transponder and a receiver or an electric circuit.

As it is shown in FIG. 6*b*, the operating pin 15 is arranged in a way that the middle part 3 is in direct effective contact with the operating pin 15 when the column 101 is retracted through the calibration position. On the other hand, the effective connection between the switch 5 and the middle part 3 is interrupted when the middle part 3 is extended through the calibration position when extending the column. The operating pin 15 or the middle part 3 may further have a switch unit 15*a* arranged in a way that an exact response threshold, i.e. an exact switching time is given in order to improve a calibration. In the shown embodiment, the operating unit 15*a* is arranged in a part of the middle part 3 facing the motor 1. The operating unit 15*a* is adapted to the contours of the middle part 3 in a form-locking manner in the effective contact with the operating pin 15 of the sensor unit 6. Therefore, the operating unit 15*a* is rotatably mounted about an axis. If the operating unit 15*a* looses contact with the operating pin, the operating unit 15*a* erects, for instance by means of a spring, and towers the contours of the middle part 3 in an area facing the upper thrust rod 2.

If the column 101 is extended again, the operating unit 15*a* comes again in effective contact with the operating pin 15 and tips again against the wall of the middle part 3. Therefore, a release of the switch 15 occurs exactly in the moment when the operating pin 15 is not in effective contact with the operating unit 15*a* anymore. Therefore, the exact position or the exact moment for the calibration is given.

The sensor unit 6 further has a connection braid 16, which establishes an electrical contact with the control unit (not shown). The control unit can be arranged on the table-plate 15, on the column 100, 101 or decentralized. Also, a remote control is conceivable.

It is also conceivable that a column according to the invention has both, a limit stop surface with an upper limit stop and also a sensor unit 6 for calibration as calibrating means. In this way, an ongoing calibration during the normal operation of the column can be carried out while a so-called reset is also possible in a maximum extended position of the column.

It is also conceivable that a plurality of sensors such as the sensor unit 6 are arranged along the upper thrust rod 2 or the middle part 3, respectively, in order to carry out further calibrations, e.g. of the motor speed, etc.

Further, it is not critical to the effective application of the invention whether the sensor unit 6 is mounted on the upper thrust rod 2, the middle part 3 or on the lower thrust rod 4.

In further embodiments of the invention, it is also conceivable that the furniture or the column itself is provided for detecting the distance, e.g. from a top edge of the column or a plate of the furniture to the bottom, by means of a sensor.

Hereafter, it will be described a method by which a calibration of a column according to the invention can be achieved.

The motor 1 drives the spindle 5 for height-adjustment. Due to the interaction with the middle part 3, the spindle converts the rotation of the motor in a transversal movement which causes a lifting or lowering of the upper thrust rod 2 and therefore of the motor and, if applicable, the upper part of a furniture arranged on the upper thrust rod. Due to the connection of the steel belt between the two rollers, the movement of the upper thrust rod 2 in relation to the middle part 3 is also transferred to the lower thrust rod 4. Since the roller 9*b* is movably arranged in the lower thrust rod 4, and the lower thrust rod 4 is fixedly arranged on the bottom's side 22, it is further caused a lifting- or lowering-movement of the middle part 3, respectively.

Thereby, it is also conceivable that only one movable part is provided.

For calibration or synchronization of a column 100, 101 by means of a controller (not shown), a fixed reference-point is necessary at which the controller sets its zero-point. For calibration of the column according to the invention, the column 100, 101 is transferred from a retracted into an extended position. In a preferred embodiment, the calibration occurs in the maximum extended position so that a limit stop surface 14 comes into effective contact with the upper limit 13 of the spindle 5. When it is recognized, e.g. due to a torque-increase of the motor 1, that no further movement of the spindle along the middle part 3 occurs, the rotation of the motor is stopped and the controller unit initiates a setting of the zero-point of the column (reset). Thus, the reference point of the column 100, 101 was set.

In a method according to an alternative embodiment of the invention, the calibration position is not located in a maximum extended position of the column 101 but in a partly extended position. Here, the calibration is achieved by passing a sensor unit 6 when extending or retracting the column 100, 101 during the operation or in a special calibrating cycle. It is thereby not necessary to retract the column 100, 101 up to a mechanical blocking situation of the retraction-movement.

It is conceivable that the calibration is refined due to a calibration position of the column 100, 101, which is, e.g. by means of an operating unit 15*a* and an operating pin 15, is passed and operated several times, wherein the column performs a pendulum-movement about the calibration position. By doing so, the column is moved e.g. from a retracted position in an extended position beyond the calibration point, and is, after recognizing the exceeding of the calibration position, retracted again by reversing the direction of movement of the calibration point, wherein the amplitude about the calibration point decreases with every cycle until, finally, the exact reference point is found.

It is obvious that also combinations of the described embodiments of the column, the furniture and the method are conceivable, as long as they don't explicitly exclude each other.

In summary, the invention relates to a column that can be calibrated, in particular for a piece of furniture, wherein the column 100, 101 that can be calibrated has a stationary part 4, at least one movable part 2, 3, and a calibrating means 6, 13, 14, and the movable part 2, 3 can be transferred from a retracted state to a plurality of extended states, and wherein a calibration position of the column 100, 101 coincides with the position of the movable part 2, 3 in an extended state. Such a column can be used in a piece of furniture as an extendable column.

The invention claimed is:

1. An adjustable-length column that can be calibrated, wherein the column that can be calibrated comprises telescopic parts including a stationary part and at least one movable part, a driving mechanism having a motor arranged in the telescopic parts and connected to a spindle having an ascending screw thread that causes an adjustment of the length of the column between a retracted state and a completely extended state, a controller for controlling the driving mechanism, a middle part interacting with the screw thread, the position of the middle part relative to the screw thread varying as the length of the column is adjusted between the extended and retracted states, and a calibrating means including a sensor unit having a detection means being in direct effective contact with the middle part when passing the sensor unit, the calibrating means establishing the attainment of a pre-defined calibration position of the movable part with respect to the stationary part, wherein the controller is configured to set a fixed reference point for the length-adjustment at the pre-defined calibration position, and the movable part can be transferred from the retracted state to a plurality of extended states, and wherein the calibration position coincides with a position of the movable part in a partly extended state.

2. The column that can be calibrated according to claim 1, wherein the column comprises a further calibrating means formed by a limit stop and a limit stop surface and the controller configured as a device for recognizing that no further movement of the movable part with respect to the stationary part occurs such that a further pre-defined calibration position coincides with a position of the movable part in the completely extended state.

3. The column that can be calibrated according to claim 2, wherein at least one of the movable part and the stationary part comprise a blocking means which is adapted to block a movement of the movable part beyond a predetermined position.

4. The column that can be calibrated according to claim 3, wherein the blocking means has a soft layer.

5. The column that can be calibrated according to claim 1, wherein the detection means comprises at least one mechanical switch, at least one electronic switch, or at least one optical switch mechanism.

6. A method for calibrating a column according to claim 1, comprising the following steps:

moving the movable part of the column in relation to the stationary part of the column into an extended state for calibration, and thereby transferring the movable part into a pre-set calibration position so that a calibrating means establishes the attainment of the pre-defined calibration position for calibrating a position of the movable part with respect to the stationary part by coming into an effective contact with the movable part of the column and a controller unit causes a setting of the column after reaching the calibration position, and passing the movable part through the pre-set calibration position several times and thereby achieving the calibration.

7. A piece of furniture with at least one adjustable-length column that can be calibrated, wherein the column that can be calibrated comprises telescopic parts including a stationary part and at least a movable part, a driving mechanism, arranged in the telescopic parts, adjusting the length of the column between a retracted state and a completely extended state, a controller for controlling the driving mechanism, and a calibration means establishing the attainment of a pre-defined calibration position for calibrating a position of the movable part with respect to the stationary part, wherein the controller is configured to set a fixed reference point for the length-adjustment at the pre-set calibration position, and the movable part can be transferred from the retracted state in a plurality of extended states, and wherein the calibration position coincides with a position of the movable part in a partly extended state.

* * * * *